United States Patent [19]

Mohn et al.

[11] Patent Number: 4,487,650

[45] Date of Patent: Dec. 11, 1984

[54] LABELING MACHINE

[75] Inventors: Hans-Werner Mohn, Kaarst; Heinz-Jürgen Rosenberg, Neuss, both of Fed. Rep. of Germany

[73] Assignee: Jagenberg Aktiengesellschaft, Dusseldorf, Fed. Rep. of Germany

[21] Appl. No.: 586,904

[22] Filed: Mar. 9, 1984

[30] Foreign Application Priority Data

Mar. 12, 1983 [DE] Fed. Rep. of Germany ..... 3308934

[51] Int. Cl.[3] ..... B65C 9/04; B65C 9/40

[52] U.S. Cl. ..... 156/567; 156/447; 156/456; 156/DIG. 26; 156/DIG. 27; 156/DIG. 44

[58] Field of Search ..... 156/378, 379, 447, 456, 156/567, 568, 571, DIG. 25, DIG. 26, DIG. 27, DIG. 44

[56] References Cited

U.S. PATENT DOCUMENTS 2,657,816 11/1953 Everett ..... 156/567
2,708,502 5/1955 Carter ..... 156/DIG. 27
3,546,047 12/1970 Dullinger ..... 156/568

FOREIGN PATENT DOCUMENTS 927691 6/1963 United Kingdom ..... 156/DIG. 27

*Primary Examiner*—Michael Wityshyn
*Attorney, Agent, or Firm*—Sprung, Horn, Kramer & Woods

[57] ABSTRACT

The invention concerns a labeling machine for bottles that are to have one or more labels applied to them in a position determined by a specific indication on the bottle. Before the first label is applied, the bottles, which are secured between a rotating plate and a rotating head, are probed for the indication and rotated by an electric motor. The rotation from the motor is introduced through one input of a differential gear. Rotations derived from an invariable labeling program are introduced through the other input. The bottles can accordingly be positioned in the desired orientation without being loosened between the rotating plate and rotating head and without using a frictional clutch or gearshift.

8 Claims, 3 Drawing Figures

LABELING MACHINE

BACKGROUND OF THE INVENTION

The present invention relates to a labeling machine for articles like bottles and consisting of an intake star, a take-out star, and a turntable positioned between them and having distributed around its circumference several accommodations in which the article is secured between a rotating plate and a rotating head while it is transported alongside a labeling station and alongside label applicators or contactors, whereby a rotary drive mechanism with an invariable program, supplied in particular by a stationary cam, is provided to rotate the rotating plate and head during transport through the bottle holder and controls with a sensor that detects an indication on the circumference of the article are provided to orient the articles in a rotated position and control the rotary drive mechanism independently of the invariable program in such a way that the article is rotated into a desired initial orientation before it arrives in the vicinity of the labeling station.

Labeling machines of this type are known. They are intended for applying labels to bottles in a particular orientation to an indication on the article. The stoppers themselves are utilized as the indications that are detected by the sensor in one known labeling machine of the aforesaid type that is intended for patent-stoppered bottles. The advantage of a labeling machine of this type, in which the article is oriented while it is in the bottle holder in which the bottles are suplied secured between a rotating plate and a rotating head to the labeling station, over a labeling machine in which the article is oriented while it is in an intake star or intermediate star upstream of the bottle holder is that a potential source of undesired rotation subsequent to orientation and during transfer from the intake star to the bottle holder is eliminated. There is, however, a drawback to this type of machine in that it can orient only bottles with patent stoppers because the stoppers are exploited as positive mechanical stops. The system is not applicable to articles that have indications that are strictly optical, electromagnetic, or detectable by similar means (as in prior German Patent application No. P 32 44 485.0-27, not yet opened for inspection).

In addition to the drawback that only bottles with mechanically detectable indications can be oriented, there can be another in that a coupling, a friction clutch for example, must be introduced into the sequence to deactivate the torque delivered by the stationary cam to the rotating plate when the article has been oriented as desired.

SUMMARY OF THE INVENTION

The object of the present invention is a labeling machine for articles like bottles and of the aforesaid type in which articles can be oriented as desired independently of the type of indication without couplings or friction clutches.

This object is attained in accordance with the invention in that the rotary drive mechanism for each accommodation has a differential gear with one input coupled to a mechanism that drives the rotation in accordance with the invariable program and the other input to a motor governed by the controls.

The bottle, once it has been secured between the rotating plate and the rotating head upon being transferred from the intake star, remains secured to the turntable throughout its travel. The article is oriented to the indication strictly by the motor. The invariable program, which can be supplied in particular by a stationary cam and is needed to rotate the article alongside the labeling station and the label applicators or contactors, remains completely unaffected. The system can be designed so that no orienting motion is introduced into the differential gear by the drive mechanism through one input while the motor is orienting the article. In this case the rotation of the rotating plate and head is controlled strictly by the motor. Whereas the torque transferred to the rotating plate through the coupling by the mechanical stop in the labeling station disclosed in the prior patent application must be absorbed by the bottle once the orientation has been attained so that the friction clutch can come into action, the article being oriented in the labeling machine in accordance with the invention is never stressed, either while it is being oriented or once it has been oriented. The rotary drive mechanism, specifically, is turned off once the bottle has been oriented. The article, which has been secured in any desired orientation between the rotating plate and the rotating head, is accordingly positioned in the desired initial orientation and without becoming loose before arriving in the vicinity of the labeling station, whence it is rotated in accordance with the invariable program.

In one embodiment of the invention the initial orientation that is necessary for the rotation of the article in accordance with the invariable program can be obtained without releasing the article once it has been secured between the rotating plate and the rotating head. The rotary drive mechanism in this embodiment consists of a motor that is governed exclusively by the controls in the stretch between the intake star and the vicinity of the labeling station and only in accordance with the invariable program over the rest of the route. Whereas the rotary drive mechanism in the first embodiment is of a combined mechanical and electric design, that in the second embodiment is strictly electric. The advantage of a strictly electric design over a combined design is that the invariable program is easier to change.

When more than one label, a front plus a rear label for example, are to be applied to the articles, it is practical for the orientation of the object to be tested and possibly readjusted before the second label is applied. Reorientation may be necessary because unintended rotation of the object on the rotating plate can not be completely eliminated, especially while the first label is being applied. The article can easily be reoriented in accordance with the invention in that the controls are activated upstream of each additional labeling station and the motor is activated whenever a rotation is detected. The controls can utilize either the original indication to detect the rotation or another indication specially associated with the new label. Another indication is necessary when the original indication is covered by the first label. When for example one drive mechanism is guided by a lever arm along a stationary cam that defines the invariable program, the differential gear is preferably a planetary gear with a sun wheel that has inside and outside teeth and that is mounted in such a way as to rotate freely in the turntable with one set of teeth engaging a planet wheel that is driven by the motor and the other set engaging a planet wheel that can be adjusted by a lever arm and that meshes with a cogwheel connected to the rotating plate.

Since the articles are oriented by the turntable in the first section of the path along which they are transported by the turntable, the stationary cam should exert no control motion on the rotating plate. This means, however, that the drive mechanism that indicates the rotation pursuant to the stationary program must assume the initial position that is necessary in the vicinity of the first labeling station prior to the initial section of the transport path. Satisfying this requirement can, however, lead to problems when the articles are transferred from the turntable to the take-out star if the article must be rotated on another section of the transport path, because of a second labeling station for instance. In this case, specifically, a point at which the articles can be transferred to the take-out star will be needed in order to return the drive mechanism to its original position. This leads to the articles carrying out an inherent rotation while being transferred to the take-out star. An inherent rotation is not only undesirable because of stress to the labels but also prevents further processing of the articles that must be carried out in correct orientation to the bottles, like wrapping the remaining part of the top when the tops are to be foiled, etc. These problems can, however, easily be remedied in a labeling station in accordance with the invention in that the controls govern the motor in such a way that the rotation introduced into the differential gear by the drive mechanism is compensated by a rotation introduced into the differential by the motor.

A preferred embodiment of the invention will now be described with reference to the attached drawings, wherein

DETAILED DESCRIPTION OF THE PREFERRED EMBODIMENT

Figure 1:
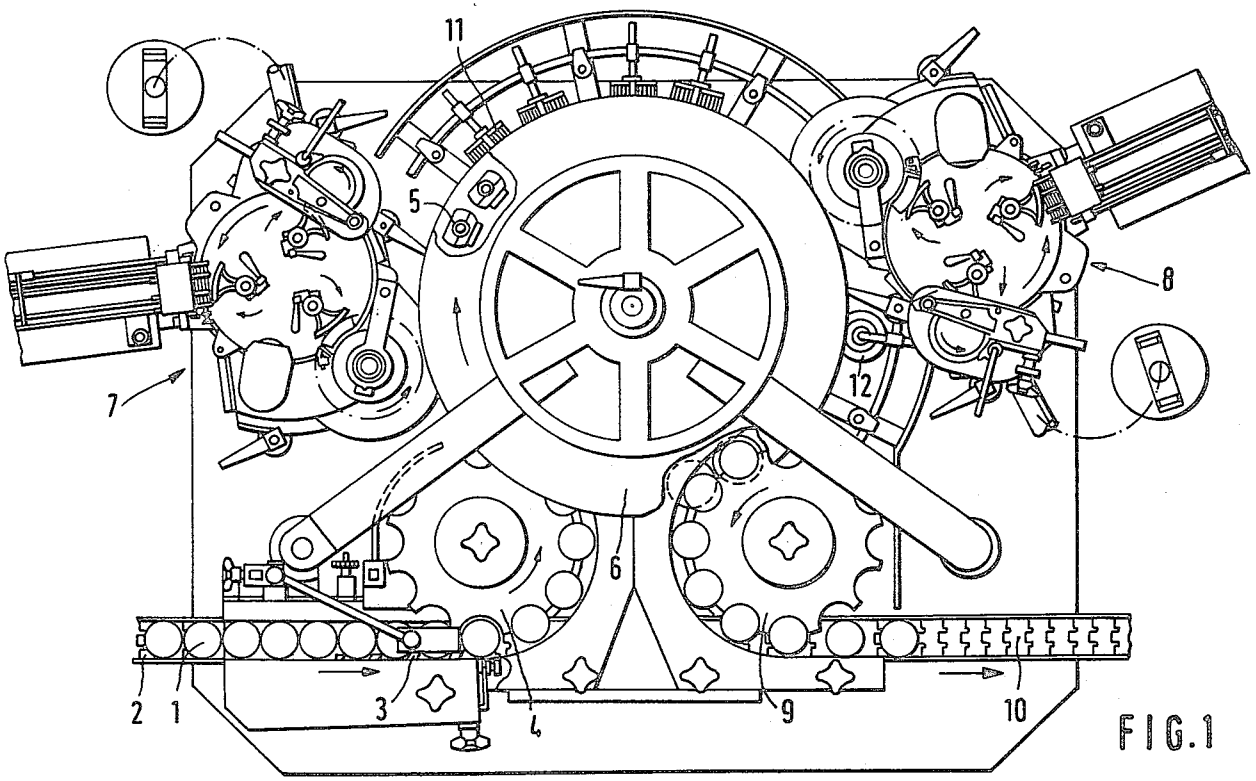
FIG. 1 is a schematic top view of a labeling machine with two labeling stations.

The articles, bottles 1 for example, to be labeled are supplied individually, upright, and in a row from a plate belt 2 to a separating worm 3 that separates them and supplies them separately to an intake star 4. Intake star 4 transfers bottles 1 individually to accommodations 5 in the circumference of a turntable 6 that transports them alongside an initial labeling station 7 and a subsequent labeling station 8 to a take-out star 9 whence they arrive on a another plate belt 10. The design of labeling stations 7 and 8 is known and will not be described in detail herein except to say that labeling station 7 can for example apply a belly label and if necessary a shoulder label as well to the bottles, whereas labeling station 8 can apply a rear label. Perfect application of the labels or sections of foil is ensured with brushes 11 or rollers 12 positioned along the path that the bottles are tansported over. To orient bottles 1 in the positions necessary for the sections of label to be brushed on and for the rear labels to be applied, they are secured by known means between a rotating plate and a rotating bottle head, with the rotating plate being rotated by means of a rotary drive mechanism in accordance with the contour of a stationary cam.

Figure 2:
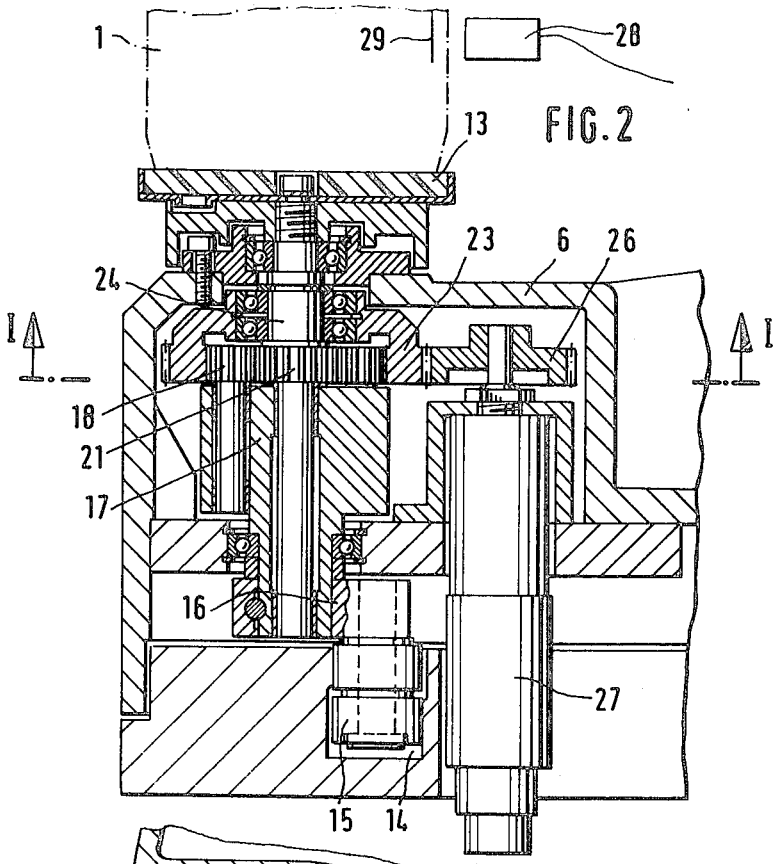
FIG. 2 is an axial section through a rotating plate on a labeling station of the type illustrated in FIG. 1.
Figure 3:
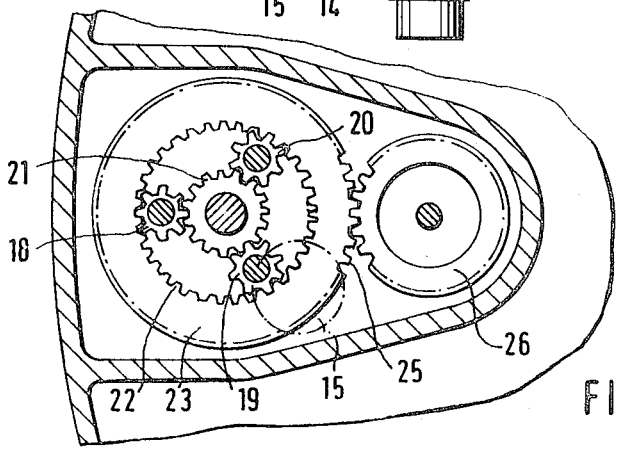
FIG. 3 is a section along line I—I in FIG. 2 through the drive mechanism of a rotating plate like that illustrated in that figure.

FIG. 2 shows a section of the bottom of turntable 6 with a plate 13 mounted in such a way that it can rotate in it. A stationary cam 14 is probed by a pair 15 of rollers on one arm 16 of a lever when turntable 6 rotates. Lever arm 16 is connected, in such a way that it cannot rotate, to a hollow shaft 17 that is mounted in such a way that it can rotate in turntable 6. Three cogwheels 18, 19 and 20 are mounted in such a way that they can rotate on hollow shaft 17. Cogwheels 18, 19 and 20 mesh on the one hand with a cogwheel 21 that is mounted in such a way that it can rotate about in the center of hollow shaft 17 and on the other with the inner teeth 22 of a sun wheel 23 that is mounted in such a way that it can rotate freely in turntable 6. Central cogwheel 21 is connected, in such a way that it cannot rotate, to rotating plate 13 by a shaft 24. One cogwheel 26 of an electric motor 27, a stepper motor for example, meshes with the outer teeth 25 of sun wheel 23. Motor 27 is governed by controls that are not illustrated. A sensor 28 associated with the controls remotely probes one of the bottles 1 on turntable 6 for an indication 29, a strip embedded in the bottle for example.

The orientation of the bottles 1 in a labeling machine in accordance with the invention will now be described.

At the point where bottles 1 are transferred from intake star 4 to turntable 6, pair 15 of rollers is positioned on a section of stationary cam 14 that is at a constant radial distance from the axis of rotation of turntable 6. Hence, no rotation will issue from the drive mechanism of the rotating plate 13 with the invariable rotation program. The controls are activated subsequent to the transfer of bottles 1 so that sensor 28 can determine whether a bottle is in the desired orientation. If the desired orientation is not confirmed, motor 27 is started up and introduces a rotation into differential gear 18, 21, and 23, rotating plate 13 with the bottle on it. As soon as sensor 28 detects an indication 29, motor 27, which is a braked motor, is cut off. From now on the rotation will occur only in accordance with the invariable program, i.e. depending on the contour of stationary cam 14.

If desired, however, a bottle 1 can be reprobed with respect to its orientation before another label, a rear label or a section of foil for example, is applied. In this case as well, stationary cam 14 will not introduce any rotation into differential gear 18, 21 and 23 while motor 27 is orienting the bottle.

Finally, it is also possible with repect to the return of lever arm 16 to its initial position to turn on motor 27 in the vicinity of take-out star 9 so that the rotation introduced into differential gear 18, 21, and 23 by lever arm 16 will be completely compensated by a rotation introduced into the differential gear by motor 27. When the rotation is compensated in this way, the bottles will be transferred to take-out star 9 with no adherent rotation.

It is understood that the specification and examples are illustrative but not limitative of the present invention and that other embodiments within the spirit and scope of the invention will suggest themselves to those skilled in the art.

We claim:

1. In a labeling machine for articles like bottles and comprising an intake star, a take-out star, a turntable positioned between the intake and take-out stars and having distributed around its circumference a plurality of accommodations in each of which an article will be secured between a rotating plate and a rotating head while it is transported alongside a labeling station and alongside label applicators or contactors, a rotary drive mechanism with an invariable program, supplied by a stationary cam, to rotate the rotating plate and head during transport through the bottle holder, and controls with a sensor that detects an indication on the circumference of the article to orient the articles in a rotated position and control the rotary drive mechanism independently of the invariable program in such a way that each article will be rotated into a desired initial orientation before it arrives in the vicinity of the labeling station, the improvement wherein the rotary drive mechanism for each accommodation includes a differential gear with one input coupled to a mechanism that drives the rotary drive mechanism in accordance with the invariable program and another input coupled to a motor governed by the controls.

2. A labeling machine according to claim 1 including a plurality of labeling stations and a plurality of respective controls, the controls upstream of each subsequent labeling station serving to correct the orientation of an article if necessary.

3. A labeling machine according to claim 1, in which one drive mechanism is guided by one arm of a lever along a stationary cam that determines the invariable program, the differential gear comprising a planetary gear with a sun wheel that has inside and outside teeth and that is mounted in such a way as to rotate freely in the turntable with one set of teeth engaging a planet wheel that is driven by the motor and the other set engaging a planet wheel that can be adjusted by a lever arm and that meshes with a cogwheel connected to the rotating plate.

4. A labeling machine according to claim 1, wherein, when the invariable program introduces a rotation into the rotating plate and the rotating head in the vicinity of the take-out star, the controls govern the motor in such a way that the rotation introduced into the differential gear by the drive mechanism is compensated by a rotation introduced into the differential by the motor.

5. In a labeling machine for articles like bottles and comprising an intake star, a take-out star, a turntable positioned between the intake and take-out stars and having distributed around its circumference a plurality of accommodations in each of which an article will be secured between a rotating plate and a rotating head while it is transported alongside a labeling station and alongside label applicators or contactors, a rotary drive mechanism with an invariable program, supplied by a stationary cam, to rotate the rotating plate and head during transport through the bottle holder, and controls with a sensor that detects an indication on the circumference of the article to orient the articles in a rotated position and control the rotary drive mechanism independently of the invariable program in such a way that each article will be rotated into a desired initial orientation before it arrives in the vicinity of the labeling station, the improvement wherein the rotary drive mechanism includes a motor operatively connected with the controls such that the motor is governed exclusively by the controls in the stretch between the intake star and the labeling station but along the balance of the route is governed by the invariable program.

6. A labeling machine according to claim 5, including a plurality of labeling stations and a plurality of respective controls, the controls upstream of each subsequent labeling station serving to correct the orientation of an article if necesssary.

7. A labeling machine according to claim 5, in which one drive mechanism is guided by one arm of a lever along a stationary cam that determines the invariable program, the differential gear comprising a planetary gear with a sun wheel that has inside and outside teeth and that is mounted in such a way as to rotate freely in the turntable with one set of teeth engaging a planet wheel that is driven by the motor and the other set engaging a planet wheel that can be adjusted by a lever arm and that meshes with a cogwheel connected to the rotating plate.

8. A labeling machine according to claim 5, wherein, when the invariable program introduces a rotation into the rotating plate and the rotating head in the vicinity of the take-out star, the controls govern the motor in such a way that the rotation introduced into the differential gear by the drive mechanism is compensated by a rotation introduced into the differential by the motor.

* * * * *